United States Patent [19]

Hild et al.

[11] 4,404,831

[45] Sep. 20, 1983

[54] STRIP-GUIDE ASSEMBLY FOR A METAL STRIP COILER

[75] Inventors: Berthold Hild, Burbach-Wahlbach; Martin Braun, Kreuztal-Ferndorf; Max Münker, Hilchenbach, all of Fed. Rep. of Germany

[73] Assignee: SMS Schloemann-Siemag Aktiengesellschaft, Düsseldorf, Fed. Rep. of Germany

[21] Appl. No.: 283,004

[22] Filed: Jul. 13, 1981

[30] Foreign Application Priority Data

Jul. 12, 1980 [DE] Fed. Rep. of Germany ..... 3026524

[51] Int. Cl.[3] ..... B21C 47/06

[52] U.S. Cl. ..... 72/148; 242/78.1

[58] Field of Search ..... 72/146, 148, 371; 242/66, 78, 78.1

[56] References Cited

U.S. PATENT DOCUMENTS

| | | | |
|---|---|---|---|
| 3,073,543 | 1/1963 | Bond | 72/148 |
| 3,328,990 | 7/1967 | Sieger et al. | 72/148 |
| 4,063,440 | 12/1977 | Brashear | 72/148 |

FOREIGN PATENT DOCUMENTS

| | | | |
|---|---|---|---|
| 1156041 | of 0000 | Fed. Rep. of Germany . | |
| 1499123 | 2/1970 | Fed. Rep. of Germany . | |
| 2653725 | 6/1978 | Fed. Rep. of Germany | 242/66 |
| 2939894 | 4/1980 | Fed. Rep. of Germany | 242/78.1 |
| 546126 | 6/1942 | United Kingdom | 72/148 |

*Primary Examiner*—Ervin M. Combs

*Attorney, Agent, or Firm*—Karl F. Ross; Herbert Dubno

[57] ABSTRACT

A strip-guide assembly for a metal-strip coiler comprises a pressing roll or guide plate adapted to urge the strip into a coiled condition on a mandrel is provided with a four-pivot linkage actuated by a pneumatic/hydraulic positioning device. According to the invention, the latter device comprises a limited stroke pneumatic cylinder having a plunger portion which forms a cylinder for the hydraulically displaced piston whose rod is connected to the linkage, the pneumatic and hydraulic cylinders being independently pressurizable.

4 Claims, 1 Drawing Figure

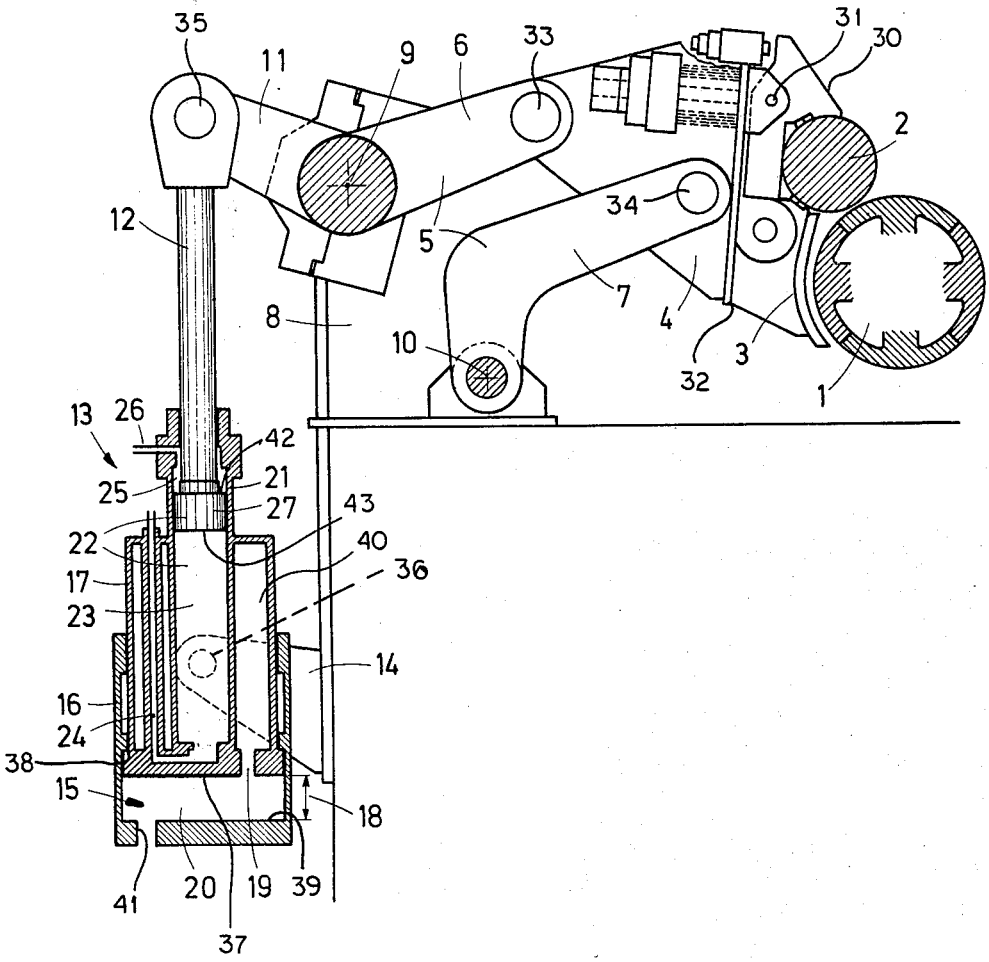
35
11
9
6
33
31
30
2
12
34
5
7
4
8
10
32
3
1
13
26
42
21
25
27
43
22
40
36
17
23
14
16
24
38
15
18
41
20
19
39
37

STRIP-GUIDE ASSEMBLY FOR A METAL STRIP COILER

FIELD OF THE INVENTION

Our present invention relates to a strip-guide assembly for a metal-strip coiler and especially a subfloor coiler adapted to be disposed along a hot-rolling strip-mill line. The invention especially is intended for the control of the pressing roller and/or guide plates or shells for such coilers.

BACKGROUND OF THE INVENTION

In the production of metal strip, e.g. steel strip by the hot rolling of slabs in a hot-rolling line, the strip which is fabricated may be coiled on a mandrel to form a strip coil or reel in a conventional band or strip coiler located beneath the floor of the strip mill.

Such strip coilers are referred to as subfloor coilers and comprise, in addition to the mandrel, a plurality of guide or pressing elements which are disposed in angularly spaced relationship about this mandrel and serve to press the oncoming strip thereagainst and against previously wound turns, or to guide the strip onto the mandrel or onto the previously formed turns.

Such guide or pressing means can include pressing rollers or rolls which are rotatable about axes parallel to the mandrel axis. The guide or deflecting plates may be in the form of arcuate shells which extend along a portion of the arc of the coil and can define a narrow gap therewith so that they can serve to deflect the strip onto the coil or the mandrel.

It is common to provide such guide or pressing elements, or both, upon an assembly which is capable of adjusting the position between the mandrel surface and the pressing or guide element, i.e. the roll or plate.

Such an assembly can comprise a so-called four-pivot linkage having at least two arms, each of which is pivotally connected at one end to a head carrying the pressing or guide element.

The other ends of these arms are pivoted as well so that the pivots and the two arms form the vertices and two sides of a quadrilateral and any displacement of the linkage results in a displacement of the pressing roll or guide plate generally parallel to itself toward or away from the mandrel.

This linkage can be actuated by a combined pneumatic hydraulic unit which serves for closing and opening the pressing roll assembly with respect to the coiling mandrel.

Subfloor strip coilers for hot-rolling strip mills have generally comprised in the past a large volume pneumatic cylinder which serves to position the pressing rollers, i.e. moving them toward and away from the mandrel and correspondingly displacing any deflecting or guide shell.

Such large volume pneumatic cylinders have been found to be disadvantageous in practice when the pressing roll or guide shell is to be swung toward or away from the mandrel.

As is described in *Technical Review,* February 1978, Mitsubishi Heavy Industries, Ltd., pages 1–10, a hydraulic shock absorber can be combined with a pneumatic cylinder for the pressing rolls or guide shells of subfloor strip coilers.

Such hydraulic shock absorbers differ from conventional hydraulic cylinders in that the piston rod of the shock absorber contains a piston-forming pressure accumulator. The latter accumulator has on one side compressed nitrogen gas while on the other side a hydraulic pressure is developed by a working piston displaceable in the hydraulic cylinder. By pressurization of the piston shiftable in this cylinder with fluid under pressure, the piston rod is brought into a position in which the pressure of the nitrogen gas is in equilibrium with the hydraulic pressure. The use of such a hydraulic shock absorber for actuating the position device for the pressure roll and/or a guide plate for a strip coiler has a significant advantage over pneumatic systems alone in that it allows a reduction in the stress which may result from the interaction of the pressure roller and the periphery of the strip coil during the coiling operation and also results in a more rapid presetting of the pressing roll by reducing the distance of the latter from the strip coil periphery.

With the strictly pneumatic control, the response of the pressing roll or the guide varied depending on the displacement of the pneumatically actuated piston while, in the arrangement of the hydraulic shock absorber, the operating characteristics of the nitrogen accumulator depended directly upon the prevailing working pressure of the fluid medium feed to the hydraulic cylinder. The spring rate of the nitrogen accumulator was thus a function of the prevailing working pressure of the hydraulic fluid and could not be selected independently thereof.

OBJECTS OF THE INVENTION

It is the principal object of the present invention to provide an improved apparatus of the type described, i.e. a positioning device for a pressing roll or guide plate of a strip coiler, whereby the disadvantages of the aforedescribed devices can be obviated.

Another object of the invention is to provide an improved control arrangement for the strip-guide members of a subfloor strip coiler for a hot-rolling strip-mill line which provides a more reliable positioning of the controlled member with respect to the coil or mandrel surface.

It is also an object of the invention to provide a positioning unit capable not only of displacing the pressing roll against the surface of the coiling mandrel of a strip coiler prior to the in-feed of the forward end of the strip, but also a controlled outward deflection of the pressing roller after strip in-feed and for the application of the pressing roll to the periphery of the strip coil prior to the passage of the trailing strip end after a prepositioning of the roll during the coiling phase.

It is still a further object of the invention to provide a device for the purposes described which will allow application of the pressing roll from its preliminary position to the periphery of the coil prior to passage of the trailing end of the strip with a reduced or minimal velocity such that any impact energy against the coil is minimized.

SUMMARY OF THE INVENTION

These objects and others which will become apparent hereinafter are attained, in accordance with the present invention, in a positioning assembly for a guide member of a strip coiler, e.g. for the pressing roller and/or a guide plate for the incoming strip, which comprises a four-pivot linkage upon which the guide member is supported for movement toward and away from the coiling mandrel, and a pneumatic-hydraulic unit comprising a stroke-limited pneumatic cylinder and a hydraulic cylinder formed in the pneumatic cylinder and acting upon one of the arms of the linkage, the hydraulic pressurization of the hydraulic cylinder being independent from the pneumatic pressurization of the pneumatic cylinder.

The positioning device as thus constituted allows the primary movement to be controlled by the hydraulic cylinder and, via the hydraulic fluid flow, to control the speed so that it is maintained substantially constant, independently of load changes.

To initially position the pressing roll, e.g. for the feed of the strip onto the mandrel, the pneumatic cylinder is energized and displaces the roller toward the mandrel, the pneumatic pressure maintaining the pressing roll against displacement with a substantially constant spring rate or force because, in spite of the high compressibility of the air, a large volume of air is provided in the pneumatic cylinder and in the plunger-forming portion thereof which is axially elongated and can form or enclose the hydraulic cylinder. Because of this high volume, there is no noticeable force increase in the pneumatic cylinder upon displacement of the pressing roll.

According to another feature of the invention, the limited stroke of the pneumatic cylinder corresponds to the maximum swing or stroke of the pressing roll and/or the guide or deflection plate forming the guide member and the plunger piston is displaceable with the same stroke by the compressed air into its extended position. Building of the coil can result in displacement of the plunger piston into its retracted position.

This not only provides a minimum axial length for the hydraulic cylinder arrangement but also ensures that the primary positioning of the pressing roll is effected exclusively by the hydraulic cylinder and that a predetermined spring constant is maintained for the pneumatic cylinder.

According to yet another feature of the invention, the plunger piston of the pneumatic cylinder is formed as a hollow piston and coaxially surrounds the hydraulic cylinder with a chamber communicating continuously with the working chamber of the pneumatic cylinder. It has also been found to be advantageous to make the working stroke of the hydraulic cylinder greater than the limited stroke of the pneumatic cylinder and at least equal to the length of the plunger piston.

The hydraulically actuatable piston is preferably formed as a differential piston and the hydraulic pressurization means can include chambers on opposite side of this latter piston connected by respective ports to the hydraulic fluid valves.

BRIEF DESCRIPTION OF THE DRAWING

The above and other objects, features and advantages of the present invention will become more readily apparent from the following description, reference being made to the accompanying drawing in which the sole FIGURE is a side view, partially in section, through the mandrel and one of the positioning units for a pressing roll or deflecting plate, serving as a strip guide member, for a strip-coiling apparatus which, it should be understood, may have a plurality of such guide members and respective positioning devices spaced apart around the mandrel, the strip coiler being preferably a subfloor coiler for a hot-rolling strip mill line.

SPECIFIC DESCRIPTION

In the drawing, we have shown a coiling mandrel 1 representing the usual strip coiling machine for a subfloor strip coiler in a hot strip mill, especially for the production of strip steel.

The mandrel 1 cooperates with a drive (not shown) as well as with a plurality of guide members which can be either pressing rolls 2 or strip deflecting plates 3, or both, which can be positioned relative to the mandrel 1 by respective mechanisms. Generally a plurality of such mechanisms and guide members are provided in spaced-apart relationship around the mandrel. As the strip is fed thereto, it is guided onto the mandrel and then onto preceding turns of the coil as it is built, the pressing rolls ensuring gradual conformation to the coil curvature and establishing the tightness of the coil winding.

The pressing rolls 2 and the deflecting plate 3 are mounted upon a carrier 4. The roll 2 can be received in a pivotable member 30 articulated at 31 to a flange 32 of the carrier which, between the pivots 33 and 34 of a four-pivot linkage, forms one arm of this linkage.

The four-pivot linkage generally represented at 5, comprises a pair of arms 6 and 7 which have pivots 9 and 10, respectively, on a fixed support or frame 8.

It will be apparent that the four-pivot linkage enables displacement of the roll 2 and the deflecting plate 3 generally parallel to themselves.

The arm 6 is formed as a bell crank lever having another arm 11 pivotally connected at 35 to a piston rod 12 of a pneumatic-hydraulic unit represented at 13 and carried by an outrigger 14 from the support frame 8. More specifically, the arm 14 has a pivot 36 upon which the cylinder housing 16 is swingably mounted.

Housing 16 defines a pneumatic cylinder 15 which cooperates with the pneumatic piston 37 so that the latter is of the limited stroke type, being displaceable between an upper abutment 38 and a lower abutment 39.

The pneumatic piston 37 is formed with a plunger portion 17 which extends axially away from the cylinder 15 and is hollow with the compartment 40 communicating continuously via the opening 19 in the bottom of the piston 37 with the working compartment 20 of the pneumatic cylinder.

The latter compartment communicates via a port 41 with a source of compressed air.

As a result, in spite of the relatively small displacement of the chamber 20, limited by the stroke 18 of the pneumatic piston, the total pneumatic volume is large, being equal to the volumes of the chambers 20 and 40. The result is a substantially constant spring characteristic and rate (spring constant for the compressed air in this space).

Upon application of the compressed air, the pneumatic piston is displaced upwardly, thereby extending the plunger 17 outwardly into the position shown in the drawing.

The plunger portion 17 encloses a double-acting hydraulic cylinder 22 which extends axially beyond the plunger and has compartments 23 and 25 connected by passages 24 and 26 with a hydraulic fluid supply provided with the usual control valves.

Since the surface area of the surface 42 at one side of the piston 27 is less than the surface 43 on the opposite side thereof, the piston acts as a differential piston rigid with the connecting rod 12.

When chamber 23 of the hydraulic cylinder is pressurized, the piston 27 and the rod 12 are moved upwardly and the linkage is swung toward the mandrel to bring the roll 2 and/or the deflecting plate 3 into contact with the surface thereof.

By controlling the velocity of flow of the hydraulic fluid into chamber 23, the rate at which the roll 2 and the deflecting plate 3 is moved can be controlled easily. By regulating the pressure of the hydraulic fluid, we find it simple to control the pressing pressure of roll 2 against the mandrel.

Any selected position of the differential piston 27 can be locked in by balancing the hydraulic fluid forces in the compartments 23 and 25, thereby fixing the piston rod 12 and enabling further displacement of the roll only against the pneumatic cushion.

The locking of the hydraulic piston has been found to be especially desirable when, prior to the passage of the strip end into the coil, the pressing roll or deflecting plate have already been brought into a preliminary position during the coiling phase from which the remaining movement against the periphery of the coil can be effected with a reduced velocity so that the impact energy against the periphery of the coil is minimized and strip damage avoided.

To swing the pressing roll and the deflecting plate 3 away from the mandrel 1 after strip in-feed, the chamber 23 of the hydraulic cylinder is relieved and hydraulic fluid is fed to the chamber 25, thereby displacing the differential piston 27 downwardly and drawing away the linkage and the roll or plate from the mandrel.

Outward displacement of the pressing roll 2 and the deflecting plate 3 relative to the mandrel can occur either at the inception of the coiling process upon the overlapping of the leading end of the strip or at the conclusion of coiling when the trailing end of the strip passes between the pressing roll and the coil. These sharp displacements are taken up exclusively by the pneumatic cylinder 15 and hence the instantaneous acceleration is accommodated by the elastic compression of the air in the chambers 20 and 40. Because of the large air volume and high compressibility of the air, the spring constant formed by the pneumatic cylinder is substantially constant. Also the air pressure in the pneumatic cylinder can be set independently of the working pressure in the hydraulic cylinder and controlled independently thereof so that and desired spring constant can be established.

It has been found to be advantageous to connect the port 41 to a pneumatic source capable of maintaining a preset constant pressure which is adjustable, so that effective control is obtained and air leakage losses are made up.

The hydraulic cylinder 22 can have the so-called double-brake valve which is effective in both load directions and can serve as a holding valve as well. It can also act as a pressure limiter for the hydraulic tubing and allow uniform, jerk-free movement of the deflecting plate through relatively small displacements and under various force applications against the strip.

We claim:

1. A positioning device for a strip-guide member, in combination with a strip-coiling mandrel, of a strip coiler, said device comprising:

a four-pivot linkage carrying said member and displaceable to shift said member toward and away from said mandrel; and a pneumatic-hydraulic unit connected to said linkage, said unit comprising pneumatic cylinder means including a pneumatic cylinder having a workpiece chamber and a stroke-limiting pneumatic piston, said pneumatic piston being hollow, means forming a hydraulic cylinder within the interior of said hollow pneumatic piston and having a hydraulic piston connected to said linkage for displacing same, means for independently hydraulically pressurizing said hydraulic cylinder and pneumatically pressurizing said pneumatic cylinder, means defining a further chamber in said hollow pneumatic piston surrounding said hydraulic cylinder, and means continuously communicating between said chambers whereby the combined volumes of said chambers form a pneumatic cushion.

2. The device defined in claim 1 wherein said pneumatic cylinder is formed with a plunger portion extending in the direction of displacement of said pneumatic piston and extending from said pneumatic cylinder means in a limited-stroke position of said pneumatic cylinder.

3. The device defined in claim 1 or claim 2 wherein the stroke of said hydraulic piston is greater than that of said pneumatic piston and is at least equal to the length of an elongated portion of said pneumatic piston provided with said hydraulic cylinder.

4. The device defined in claim 1 or claim 2 wherein said hydraulic piston is formed as a differential piston and defines in said hydraulic cylinder a pair of independently pressurizable working compartments.

* * * * *